United States Patent [19]

Shea

[11] 4,204,709

[45] May 27, 1980

[54] SEAL FOR A PUBLIC PAY TELEPHONE STATION COIN BOX

[76] Inventor: Frank J. Shea, 258 E. Shore Trail, Sparta, N.J. 07871

[21] Appl. No.: 884,889

[22] Filed: Mar. 9, 1978

[51] Int. Cl.[2] ..... B65D 33/34

[52] U.S. Cl. ..... 292/307 R; 292/282

[58] Field of Search ..... 292/307, 308, 309, 313, 292/314, 316, 322, 325, 326, 327, 282

[56] References Cited

U.S. PATENT DOCUMENTS

| | | | |
|---|---|---|---|
| 1,315,649 | 9/1919 | Wood | 292/307 R |
| 2,845,296 | 7/1958 | Stegmaier | 292/323 |

FOREIGN PATENT DOCUMENTS

| | | | |
|---|---|---|---|
| 47758 | 2/1940 | Netherlands | 292/307 R |

*Primary Examiner*—Richard E. Moore
*Attorney, Agent, or Firm*—Patrick J. Roche

[57] ABSTRACT

A transparent seal and a pneumatic power system for automatically affixing the seal onto a staple included in a hasp utilized to lock a coin collecting box used in coin activated vending apparatus for impeding unauthorized entry into the box via the hasp to pilfer coins therefrom comprising the seal formed with an aperture in a first plane and a hole in a second plane normal to the first plane and a plunger initially disposed in the hole in a first position or nonlocking state in which both the inner and outer ends of the plunger are located on the same side of the aperture and staple, and an automatic pneumatic power system for disposing the aperture onto the free end of the staple to register the aperture and open space of the staple end with the hole and thereafter for moving the plunger from its first position into a second position or locking state in the hole in which latter position the plunger projects through the registered aperture, open end of the staple and hole to locate the inner end of the plunger on a different side of the aperture and staple, thereby affixing the seal onto staple end rendering the hasp captive to lock the coin box. In the locking state the seal is irremovable from the hole without fracturing it and the plunger therein thereby exhibiting evidence of larcenous tampering with the seal.

36 Claims, 18 Drawing Figures

SEAL FOR A PUBLIC PAY TELEPHONE STATION COIN BOX

RELATED APPLICATION

This application relates to subject matter disclosed in my copending application Ser. No. 765,532 filed Feb. 4, 1977.

TECHNICAL FIELD

This invention relates to a seal and a pneumatic power system for automatically affixing the seal onto a hasp on a coin box collecting coins in coin activated vending apparatus, and more specifically to such seal embodying a plunger movable to a locking state therein by the power system for impeding larcenous entry via the hasp into the coin box to pilfer coins therefrom.

BACKGROUND ART

Heretofore, the handling of coin boxes in coin activated vending apparatus in the field and their transportation from such apparatus to a central accounting office for auditing purposes, as well as thereat has concerned managements of such apparatus selling for example, cigarettes, coffee and the like at unattended areas in offices, factories, airports, subways and such. Still, after severe precautions and especially designed locks, accounting of the contents of the coin boxes indicated in some cases dollar values less than estimated amounts. Somehow larcenous personnel handling the coin boxes contrived to gain access therein to pilfer some of the coins from the boxes without leaving evidence of tampering with the locks. This has resulted in substantial dollar losses to such coin vending apparatus managements.

It is therefore contemplated by the present invention to provide a seal for a coin box utilized at unattended marketing locations to impede larcenous entry into the coin box in the field, in transit therefrom to an accounting office for auditing the coin content thereof or in the latter office. At the accounting office an initial examination of the seal serves to disclose larcenous tampering therewith. Accordingly, the seal provided by the present invention tends to increase the hazard of detection of larcenous personnel pilfering coins from a coin box employed to collect coins in coin activated vending apparatus.

It is therefore a principal object of the invention to detect an unauthorized attempt at entry into the interior of a coin box used in coin activated self service apparatus.

Another object is to eliminate the pilfering of coins from a coin box used in coin activated vending apparatus.

Another object is to obviate dollar loss resulting from the pilfering of coins from a coin box utilized in coin activated vending apparatus.

A further object is to detect larcenous entry into the interior of a container utilized to transport therein articles of monetary value.

Still another object is to safeguard articles of monetary value during handling between different geographical points.

A still additional object is to discourage attempts at the larcenous pilfering of coins from coin collecting boxes in coin activated self-service vending apparatus.

SUMMARY OF THE INVENTION

The foregoing and other objects of the invention are achieved in accordance with a specific embodiment thereof shown in FIGS. 1 through 7 and in FIGS. 16, 17 and 18 and illustrating a seal for a coin box utilized in coin activated vending apparatus to indicate larcenous tampering with the seal on the coin box in the latter apparatus or in transit therefrom to an accounting office, or in the latter office, for auditing the coin content of the coin box.

In association with a staple included in a hasp attaching a cover to the coin box to enclose the interior thereof and in accordance with the specific embodiment of the invention, the seal comprises two dimensionally equal transparent elements bonded together into a unitary structure and provided with an aperture disposed in a first plane and hole positioned in a second plane normal to the first plane so that the hole intersects the aperture to locate a closed end on one side of the aperture and an open end on the opposite side of the aperture in an edge of one of the two bonded elements. A plunger is so disposed in a first position in the hole via the open end thereof as to locate both the inner end of the plunger adjacent to the aperture and the outer end of the plunger proximate to the open end of the hole on the opposite side of the aperture. This position constitutes the nonlocking state of the seal.

In this state the seal disposed in a No. 1 position in a third plane with its aperture facing downwardly in an automatically activated pneumatic power system embodying three air-activated pistons is moved horizontally by a No. 1 piston in the third plane to dispose the downwardly facing aperture in the seal in juxtaposition with the free end of the staple of the hasp thereby locating the seal in a No. 2 position in the power system. Thereupon, a No. 2 piston disposed in a fourth plane normal to the third plane moves the seal vertically from its No. 1 position in the fourth plane to dispose the staple free end into the aperture to register the aperture and the open space in the free end of the staple with the hole in the seal, thereby locating the seal in a No. 3 position in the power system.

Thereafter a No. 3 piston disposed at preselected angle relative to the disposition of the No. 1 piston in a fifth plane parallel to and spaced from the third plane and 90° disposed relative to the fourth plane engages the outer end of the plunger via the open end of the hole in the seal. This piston moves the plunger in the hole to pass the inner end of the plunger through the aperture and the open space of the staple free end in registration with the hole as aforesaid to locate the plunger inner end on corresponding one sides of the aperture and staple free end and the plunger outer end on corresponding opposite sides of the aperture and staple free end. The plunger now disposed in the aperture and staple free end is located in a second position or locking state in the seal.

Due to the hole being closed at its inner end on the one sides of the aperture and staple free end and a projection and an offset juxtaposed on a peripheral inside of the hole at an area proximate to but removed from the open end thereof on the opposite sides of the aperture and staple free end for engaging the plunger outer end, the plunger is irremovably disposed in its second position or locking state in the hole between the hole closed end and the latter projection and offset. As just mentioned an unauthorized attempt at the removal of the plunger from its latter locking state in the seal mars the appearance of the plunger as well as the seal structure thereby providing evidence of larcenous tampering therewith for the purpose of removing coins from the coin box. The plunger may be assigned different colors and the seal different combinations of digits, alphabetical letters or other symbols for identifying the seal used in different time periods and in different geographical areas for different purposes.

Several modifications illustrated in FIGS. 8 through 13 involve provisions for the internal peripheral surface of the hole and outer peripheral surface of the plunger different from those shown in FIGS. 6 and 7. The modifications are processed in the pneumatic power system in FIGS. 16, 17 and 18 in a manner identical with that for the specific embodiment in FIGS. 6 and 7. FIGS. 14 and 15 delineate a further modification in which the hole is rectilinear in the third plane thereby disposing the Nos. 1 and 3 pistons mutually apart at an angle of 180° in the third plane. In such event the plunger could be made in two parts rendering its removal from the hole not only more difficult but also more time consuming. Except for appropriate adjustments for such latter disposition of the Nos. 1 and 3 pistons, the further modification is processed in the pneumatic system in FIGS. 16, 17 and 18 in a manner essentially the same as that previously explained for the specific embodiment of the invention in FIGS. 1 through 7.

BRIEF DESCRIPTION OF THE DRAWING

The invention is readily understood from the following description taken together with the accompanying drawing in which.

DETAILED DESCRIPTION

Figure 1:
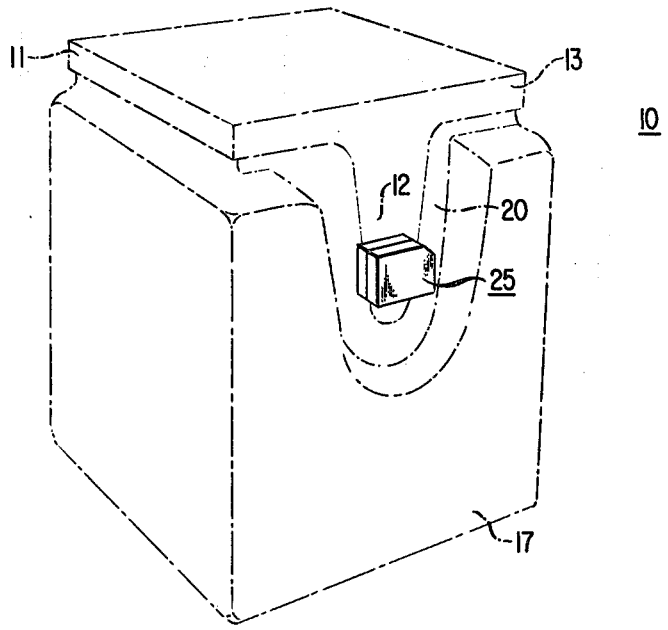
FIG. 1 is a perspective view illustrating a specific embodiment of the invention affixed to a staple included in a hasp attaching a cover to a coin box utilized in coin activated vending apparatus.
Figure 4:
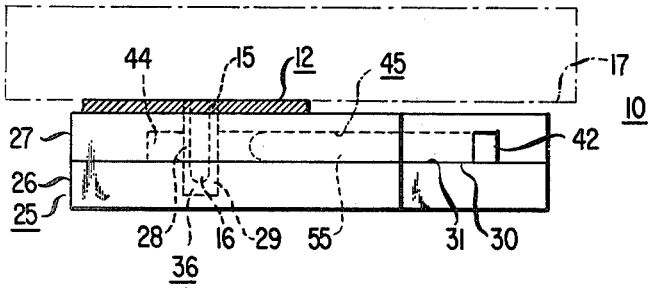
FIG. 4 is a plan view taken along line 4—4 in FIG. 2.

FIGS. 1 through 4 show a familiar type of coin box 10 indicated by dot-dash lines and provided with a movable cover 11 for enclosing the interior thereof in the well-known manner. A conventional hasp 12 has an uppermost end 13 secured to the cover and a free lowermost end 14 formed with an orifice 15. The hasp includes a staple 16 having parallel spaced adjacent ends secured to a front face 17 of the box and extending normally therefrom. Also the staple has a closed opposite free end 18 encircling open space 19 interiorly thereof. A portion of the box front face including the staple is formed with a depression 20. The staple open space and the depression serve purposes that are subsequently mentioned.

The coin box is used, for example, to contain coins serving initially to activate coin operated apparatus for vending cigarettes, sandwiches, telephone calls, coffee and the like in factories, airports, pay telephone stations, railroad and bus stations and the like. Obviously, the box could be used for transporting articles of high monetary value such, for example, as jewels, rare postage stamps, art works, diamonds, confidential papers and the like.

Figure 5:
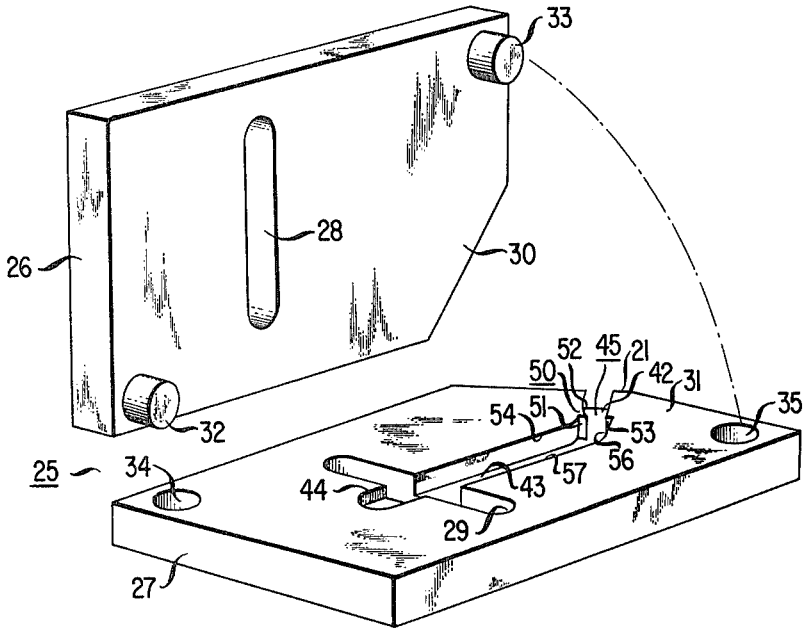
FIG. 5 is an exploded view of a component in FIG. 1.

In accordance with a specific embodiment of the invention, a transparent seal 25 shown in full lines is affixed to the staple in FIGS. 1 through 4 in a manner and for a purpose that are hereinafter mentioned. FIG. 5 illustrates a portion of the transparent seal comprising two transparent elements 26 and 27, substantially equal in dimensions, of which one element 27 is formed with orifice 29 extending completely therethrough, and surface 36 of the other element 26 is provided with a slit 28 extending partially thereinto. It is noted that the orifice and the slit are identical in both lengths and widths but differ in depths. It is further noted that when the surfaces 30 and 31 of the respective elements 26 and 27 are juxtaposed, the orifice and slit are merged to constitute effectively a unitary aperture 36 in FIGS. 2, 3 and 4. The aperture is formed with a preassigned width for a purpose later identified. The aperture is located in a first plane disposed perpendicularly to spaced parallel planes positioned in maximum dimension areas of the respective one and other elements. Surface 30 includes spaced pegs 32 and 33, while surface 31 is formed with slots 34 and 35 spaced correspondingly with the respective latter pegs so that when the two surfaces are juxtaposed the pegs accommodated tightly in the slots serve to hold the two elements juxtaposed to constitute a substantially unitary structure.

FIG. 5 illustrates surface 31 formed with a U-shape groove 40 comprising a first rectilinear U-shape segment 41 extending from an angular section 21 formed at the junction of two 90° intersecting edges of element 27 toward orifice 29 at an angle of approximately 45° relative to a horizontal axis of element 27. This segment at its right hand or outermost end 42 is open for a purpose stated below. One vertical wall 46 of this segment at its lefthand innermost end terminates in an integral projection 50 extending into the interior of the groove comprising a first portion 51 disposed substantially perpendicularly to wall 46 and a second portion 52 gradually sloping from a zenith point of the first portion toward open end 42. The dimensions of the projection are preselected for a purpose discussed later.

FIG. 5 also shows the groove formed with a second rectilinear U-shaped segment 43 having a closed lefthand or innermost end 44 extending therefrom to intersect orifice 29 at its area of minimum dimension to terminate its righthand or outermost end in an open end. The groove also includes a curvilinear U-shape segment 56 open at both opposite ends for utilizing its first vertical 54 wall to connect a corresponding rectilinear vertical wall at the open end of the second segment to first portion 51 of the projection 50 and thereby to a corresponding vertical rectilinear wall of the first segment. The curvilinear segment also utilizes its second vertical wall 57 to connect a second corresponding vertical rectilinear wall at the open end of the second segment to offset 53 at the lefthand end of a second corresponding rectilinear vertical wall of the first segment. It is thus seen that the offset extending inwardly into the interior of the first segment toward the projection and substantially opposite thereto is provided with a preselected dimension for a purpose later stated. Also, the projection and offset are located at predetermined distances from the closed end of the hole for a purpose later pointed out. The offset renders the width of the first segment less than that of the curvilinear segment. The mutually angular disposals of segments 41 and 43 in the aforesaid second plane are determined by the direction and location of depression 20 in the face of the coin box indicated in FIGS. 1, 2 and 4 as previously mentioned. Such disposals also serve a purpose later identified.

FIG. 5 further shows the groove formed throughout its entire length with an open uppermost side which is later closed via surface 30 of element 26 when the latter surface is juxaposed with surface 31 as previously mentioned. It is thus seen that the coincidence of the open side of the groove juxtaposed with surface 30 serves to form effectively hole 45 having closed and open ends 44 and 42 on one and opposite sides, respectively, of the aperture for the purpose of this description. It is additionally noted that the hole is essentially disposed in a second plane perpendicular to the first plane including the aperture. It is further noted that the aperture is coincident with areas of minimum dimensions of the respective elements 26 and 27 while the hole is coincident with areas of maximum dimensions of the latter elements, and also that the respective minimum and maximum areas are mutually perpendicular. It is also noted that the length of the hole between its open and closed ends is predetermined for a purpose later pointed out.

It is noted that the first and second planes are so mutually disposed as to intersect in such manner that the closed and open ends of the hole are located on the one and opposite sides of the aperture, and that the distances of the projection and the offset from the respective closed and open ends of the hole are preselected for purposes later mentioned. It is now recalled that the width of the aperture is preassigned as previously stated.

It is obvious that elements 26 and 27 constituting the seal are replaceable with a unitary structure, not shown, embodying the projection and offset but omitting the two opposing surfaces, the two pegs and the two slots.

Figure 6:
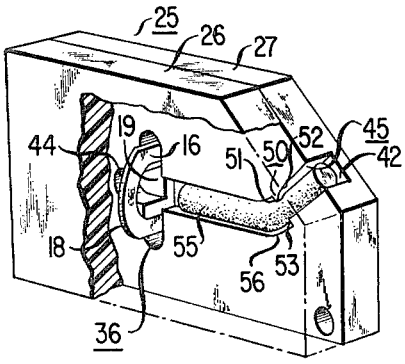
FIGS. 6 and 7 are perspective views of the specific embodiment of the invention in FIG. 1.

FIG. 6 delineating seal 25 in FIGS. 1 through 5 in a cut-away section includes hole 45 supplied with an elongated plunger 55 having a predetermined coefficient of rigidity and a preassigned shape such, for example, as a nylon circular rod. Initially, one end of the plunger of a predetermined length is manually inserted via open end 42 into the hole and thereafter the plunger is manually moved in a lefthand direction toward the hole closed end 44 to a first position shown in FIG. 6. In this position the inner or lefthand end of the plunger falls short of passing through open space 19 of staple 16 and aperture 36 while at the same time the outer or righthand end of the plunger is located proximate to open end 42. Thus both inner and outer ends of the plunger are located on corresponding opposite sides of the staple end and aperture. It is noted that such lefthand movement of the plunger is expeditiously aided via sloping portion 52 of projection 50 in FIGS. 5 and 6, and further that portion 51 of the projection bites just enough into the peripheral surface of the plunger for precluding movement thereof in the righthand direction toward the hold open end in any attempt to withdraw the plunger from the hole. Such first position of the plunger indicates a nonlocking state of the seal in FIG. 1 and is thus the condition of the seal as supplied by a manufacturer to a user.

Figure 7:
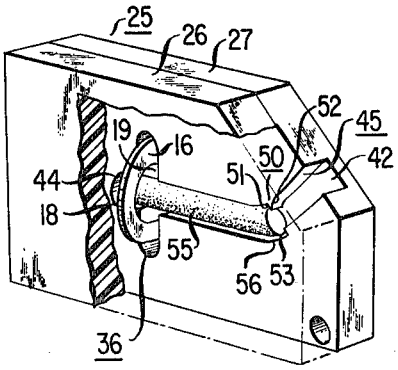

FIG. 7 illustrates a second position of the plunger in the hole after further movement of the plunger in a lefthand direction from its first position in FIG. 6 as just mentioned. This movement effected by suitable power system later described herein disposes the inner or lefthand end of the plunger through both open space 19 of staple 16 and aperture 36, FIGS. 2, 3, and 4 to a location adjacent to closed end 44 of hole 45 on corresponding one sides of the aperture and staple end and the outer or righthand end of the plunger proximate to both portion 51 of projection 50 and offset 53 on corresponding opposite sides of the aperture and staple end. Again, such further lefthand movement of the plunger is readily aided via sloping portion 52 of projection 50. Now, the plunger is irremovably fixed in its aforementioned second position for the reasons that any additional movement in the lefthand direction is blocked by the closed end of the hole while any further movement in the righthand direction is precluded effectively by projection 51 and offset 53 to thwart an unauthorized attempt to withdraw the plunger from the hole. The second position of the plunger in FIG. 7 referred to hereinafter as the locking state of seal 25 in FIG. 1 is achieved by the power system in the manner subsequently mentioned. It is obvious that the transparencies of elements 26 and 27 in FIG. 5 constituting seal 25 in FIGS. 1 and 7 readily permit an inspection of the condition and the positions of the plunger therein.

It is understood that the predetermined length of the hole, the dimensions of the projection and the offset, the predetermined distances of the projection and the offset from the closed end of the hole and the predetermined length of the plunger are fixed to achieve the aforesaid first and second positions of the plunger in the hole. It is also understood that the predetermined coefficient of rigidty of the plunger tends to maintain the plunger in an initially rectilinear shape and thereby tends to resist bending as the plunger is moved from the open end of the hole and the first rectilinear hole segment through the third curvilinear hole segment and into the second rectilinear hole segment for locating the plunger in its first and second positions in the hole as described above. Such tendency of the plunger together with the resistance of the curvilinear segment to the passage of the plunger therethrough tends to impede the removal of the plunger from its first and second positions in the hole via the open end thereof without marring the appearance of the plunger as visible in the transparent seal. This impedes larcenous entry into the coin box for the purpose of pilfering coins therefrom, and at the same time increases the hazard of detection of larcenous personnel engaging in such pilfering.

Figure 8:
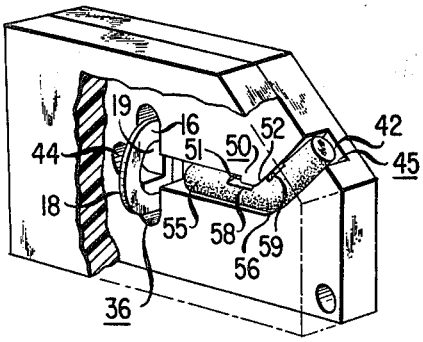
FIGS. 8 through 15 are perspective views illustrating modifications of the specific embodiment in FIGS. 6 and 7.
Figure 9:
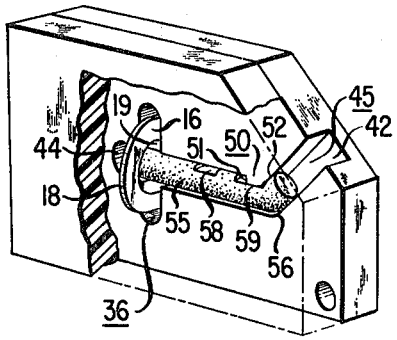

FIGS. 8 and 9 illustrating a first modification of the specific embodiment of the invention shown in FIGS. 1 through 7 includes the plunger formed with first and second recesses 58 and 59, respectively, spaced a preselected distance apart in tandem on a horizontal peripheral portion thereof. Otherwise, the structure in FIGS. 8 and 9 is identical with that in FIGS. 6 and 7. In FIG. 8 one end of the plunger is manually inserted into open end 42 of hole 45 and thereafter the plunger is manually moved in a lefthand direction in the hole to a first position therein in which the inner end of the plunger falls short of passing through open space 19 of staple 16 and aperture 36 while at the same time the outer end of the plunger is disposed proximate to open end 42. This locates both inner and outer ends of the plunger on corresponding opposite sides of the staple end and aperture. Again, such lefthand movement of the plunger is aided via sloping portion 52 of projection 50 as previously mentioned. This first position of the plunger in FIG. 8 disposes portion 51 of projection 50 in first recess 58. This precludes movement of the plunger in the righthand direction in the hole toward its open end in any attempt to withdraw the plunger therefrom. This first position of the plunger in FIG. 8 identifies a nonlocking state of the seal in FIG. 1, and thereby the condition of the seal as supplied by a manufacturer to a user.

FIG. 9 shows the plunger disposed in a second position in the hole after further movement of the plunger in a lefthand direction from its first position in FIG. 8, in accordance with the preselected distance between the recesses together with the predetermined dimensions of the pertinent components of the seal in FIGS. 6 and 7 as previously mentioned. This disposes the inner or lefthand end of the plunger through both open space 19 of staple 16 and aperture 36 to a location adjacent to closed end 44 of hole 45 on the corresponding one sides of the staple end and aperture while the outer or righthand end of the plunger is remotely disposed from open end 42 on the corresponding opposite sides of the staple end and aperture. This movement effected by the power system mentioned below and aided by sloping position 52 disposes projection portion 51 in second recess 59. At this time the plunger is forced into its last-noted second position because further movement in the lefthand direction is stopped by the closed end of the hole and any additional movement in the righthand direction in the hole toward its open end is precluded by projection portion 51 lodged in recess 59 in an attempt to withdraw the plunger from the hole. The second position of the plunger in FIG. 9 referred to below as the locking state of seal 25 in FIG. 1 is obtained in the manner explained subsequently herein. It is apparent that the transparencies of the elements 26 and 27 in FIG. 5 forming seal 25 in FIGS. 1, 8 and 9 easily permit an inspection of the condition of the seal as well as the positions of the plunger therein. Again the coefficient of rigidity and the curvilinear third segment of the hole impede removal of the plunger from the hole as hereinbefore stated regarding the seal in FIGS. 6 and 7.

Figure 10:
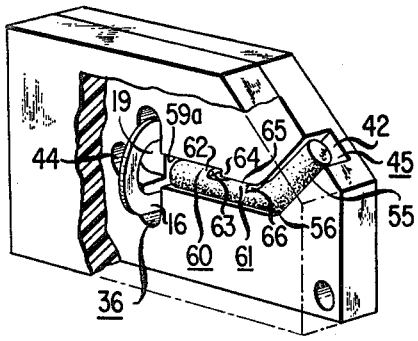
Figure 11:
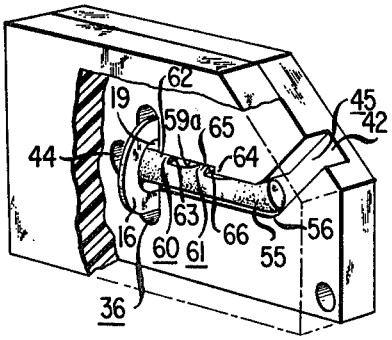

FIGS. 10 and 11 delineate a second modification of the specific embodiment of the invention in FIGS. 1 through 7. This comprises a segment of an uppermost sidewall of groove 40 formed with a depression 59*a* extending lengthwise thereof in a direction perpendicular to the first plane of aperture 36 in FIG. 8. The depression has a lefthand end terminating in a sidewall of aperture 36 on the opposite side thereof and a righthand end vertical end wall 64 located a first preassigned distance from the last-mentioned opposite side wall of aperture 36. The depression extending the preassigned distance just mentioned also includes a certain depth and preassigned width for a purpose stated below.

FIG. 10 shows plunger 55 formed with first barb 60 having a sloping portion 62 inclined toward the lefthand end of the plunger and a portion 63 disposed substantially perpendicularly to a lengthwise axis of the plunger, and a second barb 61 having sloping and perpendicular portions 65 and 66 corresponding to the sloping and perpendicular portions 62 and 61, respectively, of the barb 60. The barbs are spaced a preselected distance apart in tandem on a preselected lengthwise section of the peripheral surface of the plunger. The first barb is located a predetermined distance from the lefthand or inner end of the plunger. The dimensions of the depression and the barbs, the length of the plunger and the positions of the depression end wall and the barbs are mutually related for a purpose hereinafter pointed out.

In FIG. 10 one end of the plunger is inserted via open end 42 in the hole 45 and thereafter is manually moved from the latter opening in a lefthand direction toward closed end 44 of the hole to a first position therein in which latter position the inner or lefthand end of the plunger falls short of passing through open space 19 of staple 16 and aperture 36 while at the same time the outer or righthand end of the plunger is disposed proximate to open end 42. Thus both inner and outer ends of the plunger are located on corresponding opposite sides of the aperture and staple end. Such lefthand movement is expeditiously aided via sloping portions 62 and 65 of the respective first and second barbs. The last-mentioned first plunger position disposes barb 60 into cut 59*a* thereby precluding movement of the plunger in the righthand direction in the hole in an attempt to withdraw the plunger therefrom. This is so because perpendicular portion 63 engages vertical end wall 64 to block the latter righthand movement. The first barb first portion is thus located a second preassigned distance from the aperture opposite side, the latter distance being substantially equal to the first preassigned distance of the depression end wall from the latter aperture opposite side. The first position of the plunger as just mentioned indicates a nonlocking state of the seal in FIGS. 1 and 10 and thereby the state of the seal as supplied by a manufacturer to a user.

FIG. 11 shows the plunger disposed in a second position in the hole after further lefthand movement from its first position in FIG. 10. This disposes the inner end of the plunger through open space 19 of staple 16 and aperture 36 to a location adjacent to hole closed end 44 on corresponding one sides of the aperture and staple end while the outer end of the plunger is retained on the corresponding opposite sides of the aperture and staple end and barb 61 is disposed into depression 59*a* in response to appropriate actuation of the plunger by the power system described below. Again, further lefthand movement of the plunger is expeditiously permitted by sloping portion 65 until barb 61 is moved into depression 59*a*. This fixes the plunger in its second position just mentioned because further lefthand 19 movement is precluded by the closed end of the hole and further righthand movement is blocked by vertical portion 66 of barb 61 engaging vertical end wall 64. Now, the second barb first portion is located a third preassigned distance from the aperture opposite side, the latter distance being substantially equal to each of the last-mentioned first and second preassigned distances of the depression end wall and first barb first portion, respectively. Also, the preselected and predetermined distances of the spacing between the barbs and the first barb spacing from the inner end of the plunger, respectively, added together locate the inner and outer ends of the plunger on the aperture one and opposite sides, respectively.

This second position of the plunger in FIG. 11 establishes the locking state of seal 25 in FIG. 1 effected via the structure in FIG. 11 which is achieved by the power system described below, and prevents withdrawal of the plunger from the hole. The transparency of the seal enables an expeditous inspection of the condition and positions of the plunger therein. Also, the coefficient of rigidity together with the curvilinear segment impede the removal of the plunger from the seal via the open end of the hole essentially for the reasons previously indicated regarding the seal in FIGS. 6 and 7.

Figure 12:
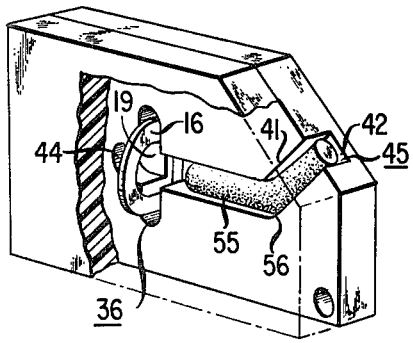
Figure 13:
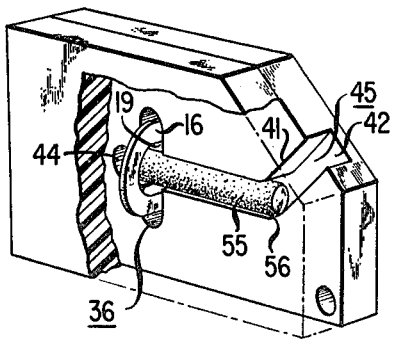

FIGS. 12 and 13 delineate a third modification of the specific embodiment of the invention shown in FIGS. 1 through 7. In accordance with this modification, it is seen that the adjacent peripheral surfaces of both the hole and plunger are relatively smooth, i.e., free from the projections, recesses, slots, cut and barbs previously mentioned in connection with the corresponding components illustrated in FIGS. 4 through 11. Initially in FIG. 12 one end of the plunger inserted via open end 42 into hole 45 and thereafter manually moved from the latter opening in a lefthand direction in the hole to its first position therein. In the latter position, the inner end of the plunger falls short of passing through both open space 19 of staple 16 and aperture 36 while at the same time the outer end of the plunger is located proximate to open end 42 of hole 45 on corresponding opposite sides of the aperture and staple end. Due to the predetermined coefficient of rigidity of the plunger together with its relatively tight fit in the hole, particularly the steep slope of first groove segment 41 relative to the respective second and curvilinear groove segments 43 and 56, movement of the plunger in a righthand direction toward open end 42 in the hole in an attempt to withdraw the plunger from the hole, is practically impossible without visibly marring the appearance of the plunger to a noticeable extent. This first position of the plunger indicates the nonlocking condition of the seal in FIG. 1, and the state of the seal as supplied by a manufacturer to a user.

FIG. 13 indicates the plunger located in its second position in the hole after further movement of the plunger in a lefthand direction from its first position in FIG. 12. This second position disposes the inner end of the plunger through space 19 of staple 16 and aperture 36 to a location proximate to closed end 44 of hole 45 on corresponding one sides of the aperture and staple end while retaining the outer end of the plunger on corresponding opposite sides of the aperture and staple end in response to appropriate actuation of the plunger via open end 42 by a power system explained hereinafter. In the light of the preselected coefficient of rigidity of the plunger together with the effect of the curvilinear third segment of the hole as above stated, its movement in a righthand direction in an attempt to withdraw it from the hole is practically impossible without visibly marring the plunger to a noticeable extent. This second position of the plunger in the hole referred to as the locking state of the seal in FIG. 1 and effected via its structure in FIG. 13 is achieved by a power system in a manner mentioned later. Again, the transparency of the seal permits easy inspection of the condition and positions of the plunger in the hole.

Figure 14:
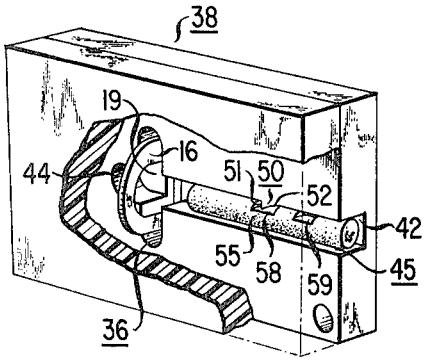
Figure 15:
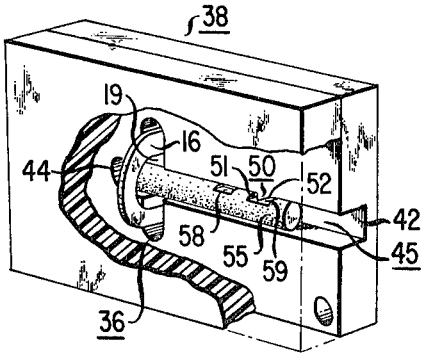

FIGS. 14 and 15 illustrate seal 38 according to a fourth modification of this specific embodiment of the invention shown in FIGS. 1 through 7. It is noted that the fourth modification is similar to the third modification in FIGS. 8 and 9 except the hole and plunger are provided with a substantially rectlinear shape.

In FIG. 14 one end of the plunger 55 is inserted via open end 42 into hole 45 and thereafter manually moved from the latter opening in a lefthand direction to its first position just mentioned. In the latter position the inner end of the plunger falls short of passing through space 19 of staple 16 and aperture 36 and the outer end of the plunger is disposed proximate to open end 42, whereby both inner and outer ends of the plunger are located on corresponding opposite sides of the aperture and staple end. In FIG. 14 portion 51 disposed in recess 58 fixes the first position of the plunger in the hole and thereby as in FIG. 8 precludes movement of the plunger in a righthand direction toward open end 42. The first position of the plunger as just mentioned indicates the nonlocking state of seal 38 as supplied by a manufacturer to a user.

FIG. 15 illustrates the plunger disposed in its second position in the hole after further movement thereof in a lefthand direction from its first position therein. This latter position disposes the inner end of the plunger through open space 19 of staple 16 and aperture 36 to a location proximate to closed end 44 of hole 45 on corresponding one sides of the aperture and staple end while retaining the outer end of the plunger on corresponding opposite sides of the aperture and staple end in response to appropriate actuation of the plunger via open end 42 by a power system described below. Due to the disposition of portion 51 in recess 59 as in FIG. 9 movement of the plunger in a righthand direction is prevented in an attempt to withdraw it from the hole without causing noticeable marring of the plunger. In FIG. 15 the second position of the plunger in the hole indicates the locking state thereof. This seal similar to seal 25 is derived from seal 38 in FIG. 14 in a manner explained hereinafter. In FIGS. 14 and 15, it is obvious that the plunger may comprise a plurality of parts. Obviously FIGS. 14 and 15 could be adapted to include the depression and barbs shown in and described previously herein with regard to FIGS. 10 and 11.

It is obvious that while the cross sections of the groove, hole and plunger hereinbefore described are indicated as rectangular for explanatory purposes, such cross sections may also comprehend geometrical configurations other than rectangular. Also, it is obvious that the cross sections of the groove, hole and plunger may comprise different combinations of geometrical shapes.

Figure 16:
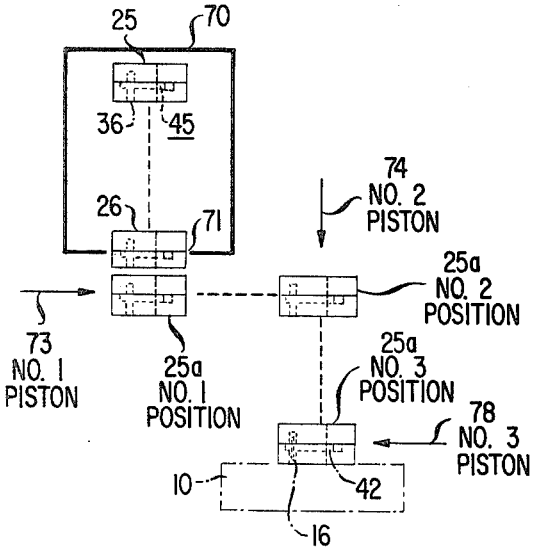
FIG. 16 is a schematic diagram of a pneumatic system utilized with the seal according to the invention in FIGS. 6 through 15 for affixing the seal to the free end of the staple in FIGS. 1 through 4.
Figure 17:
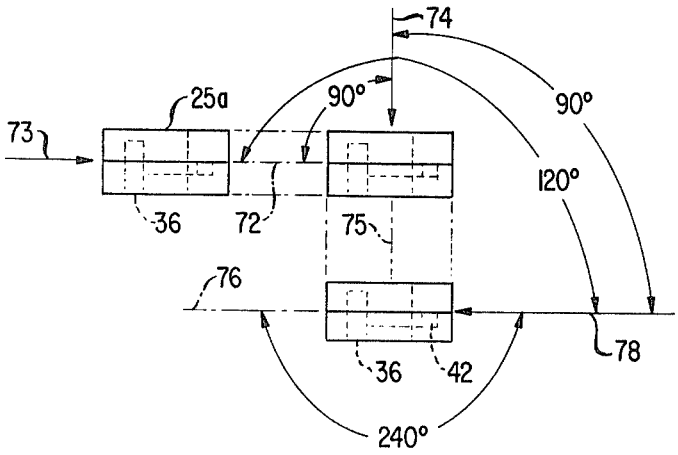
FIG. 17 is a vector diagram delinating action obtainable in FIGS. 16 and 18.
Figure 18:
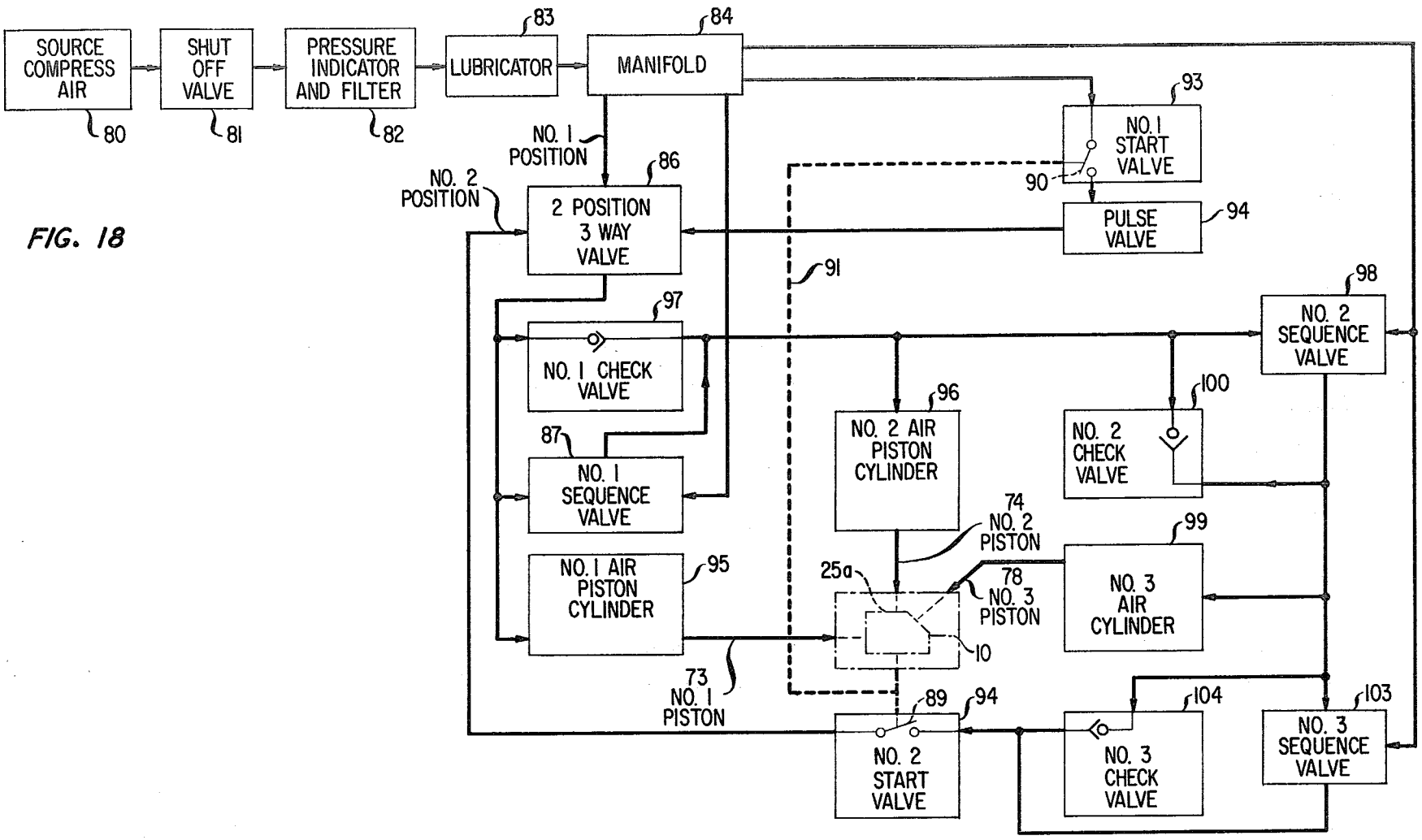
FIG. 18 is a box diagram of an automatic pneumatic system for achieving the action illustrated in FIGS. 16 and 17.

FIGS. 16, 17 and 18 show a pneumatic power system in accordance with the specific embodiment of the system for changing that above-described seals from their nonlocking states in FIGS. 6, 8, 10, 12 and 14 to their locking states in FIGS. 7, 9, 11, 13 and 15 in a manner which is presently described.

FIG. 16 represents an n number of seals 25, fifty as one example, according to FIGS. 1 and 6 stacked one on top of the other in column form with the apertures of all seals facing downwardly in a transparent container 70. This includes a bottom outlet 71 through which the respective lowermost seals, for example, seal **25*a*, drop in turn through the outlet due to the force of gravity into an area located immediately therebelow. This area designated position No. 1 is included in a third plane 72 in FIG. 17 assumed to be horizontal for the purpose of this explanation. A No. 1 piston 73 located adjacent to seal 25*a* in the No. 1** position in the third plane is activated to move seal 25*a* in the righthand direction in the latter plane to the No. 2 position therein. In this position aperture 36 of the seal faces downwardly over the free end of the staple included in the hasp of a coin box as hereinbefore mentioned.

A No. 2 piston 74 located immediately above seal 25*a* in its No. 2 position in a fourth plane 75 perpendicular to the third plane as shown in FIG. 17 is activated to move the latter seal downwardly in the fourth plane to its No. 3 position. This disposes the free end of the staple into aperture 36, and thereby seal 25*a* onto the coin box. At the end of the latter downward movement, it is understood that the open space of the free end of the staple is registered with the aperture and the hole as shown in FIGS. 2–6. Now, it is recalled that seal 25*a* is still in its nonlocking state shown in FIG. 6.

A No. 3 piston 78 in FIG. 16 is located immediately adjacent to open end 42 of seal 25*a* in its No. 3 position in a fifth plane 76 spaced below and in parallel with the third plane and perpendicular to the fourth plane in FIG. 17. This piston engages the outer end of the plunger located adjacent to the hole open end 42 and moves the plunger in an angularly lefthand direction in the hole toward the closed end thereof. This stroke moves the lefthand or inner end of the plunger through both open space 19 in the free end of the staple and the aperture to a location adjacent to the closed end of the hole. At the termination of the stroke the righthand or outer end of the plunger is disposed to engage portion 51 of projection 50 and offset 53 thereby precluding the removal of the plunger from the hole as shown in FIG. 7. Now, the plunger is disposed in its locking state as previously mentioned.

Figure 2:
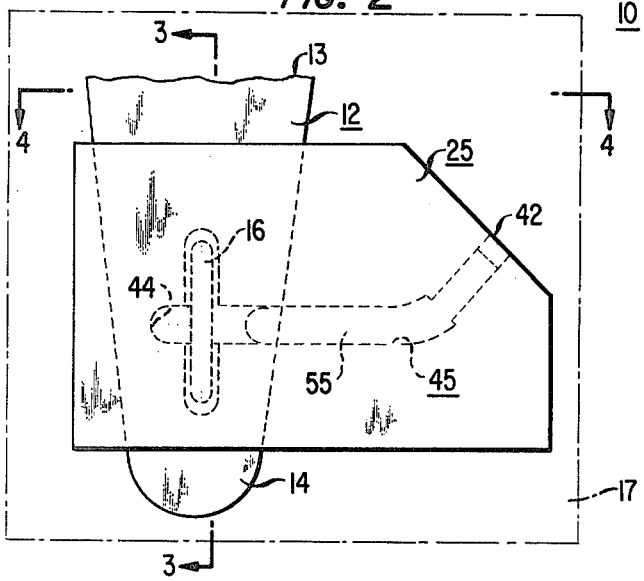
FIG. 2 is an enlarged partial front elevational view of a segment of FIG. 1 showing a preliminary condition in FIG. 1.
Figure 3:
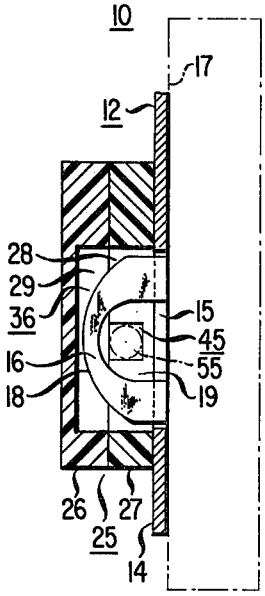
FIG. 3 is a side elevational view taken along line 3—3 in FIG. 2.

The angular disposition of No. 3 piston 78 in the fifth plane with regard to No. 1 piston 73 in the third plane is related to the location and direction of the depression 20 in the face of coin box 10 indicated in FIGS. 1 and 2. As measured in a clockwise direction from the No. 1 piston, the No. 3 piston is located approximately 120° therefrom and as measured in a counter clockwise direction from No. 1 piston, the No. 3 piston is located approximately 240° therefrom. As further shown in FIG. 17 the No. 3 piston is disposed 90° relative to the No. 2 piston for the reason that the fourth and fifth planes are mutually perpendicular as aforesaid. Such relative disposals of the Nos. 1 and 3 pistons is necessitated by the mutually angular disposition of segments 41 and 43 of groove 40 or hole 45 in FIG. 5. On the otherhand, if the front face of the coin box were disposed in one plane say, the third plane, for example, then the seal structure in FIGS. 14 and 15 could be utilized. In this case, Nos. 1 and 3 pistons could be located 180° apart in the third plane, thereby avoiding the disposal of the No. 3 piston in the fifth plane as above mentioned.

Upon the completion of the one cycle operation of FIGS. 16 and 17 stimulated by the insertion of the coin box into the pneumatic power system for the purpose of affixing the seal to the latter box as just explained, the coin box is now conditioned via the seal conditioned to its locking state for service in the field to collect coins in coin activated vending apparatus in the product market sales areas previously identified. The coin box as sealed is now removed from the power system in FIG. 16 and replaced with other individual coin boxes in turn for conditioning from the nonlocking state to the locking state in the manner just explained.

FIG. 18 illustrates a pneumatic power system for controlling the sequential operation of the Nos. 1, 2 and 3 pistons shown in FIGS. 16 and 17 as hereinbefore described. It is now assumed the pneumatic system in FIG. 18 has just completed one cycle of operation for affixing the seal in its locking state to the free end of the staple of a coin box as just explained which box thereupon is removed from the system, and the latter system is now available for the next succeeding cycle of operation. In furtherance of the operation of the latter cycle, compressed air for actuating the system is continuously supplied by source 80 through shut-off valve 81, which is now open, pressure indicator and filter 82 and lubricator 83 to manifold 84. The lubricator supplies oil for the moving components of the remainder of the system in FIG. 18. The manifold supplies the compressed air to No. 1 start valve 93, 2-position 3-way valve 86, No. 2 sequence valve 98 and No. 3 sequence valve 103, all of which valves are closed to the air at the moment as the system is in a state of rest between successive cycles of operation and a coin box is not yet positioned in the system. As a consequence push elements 89 and 90 included in the respective Nos. 2 and 1 start valves 94 and 93 are both in off-positions represented by the broken lines and interconnected via mechanical linkage 91 for simultaneous operation. The arrow heads associated with the respective system components indicate the directional air flow as the latter are operatively brought into the system.

Upon the insertion of a coin box 10 into the system in FIG. 18, push elements 89 and 90 are simultaneously actuated to operative positions represented by full lines thereby simultaneously opening Nos. 1 and 2 start valves 93 and 94. Open No. 1 start-valve passes air therethrough from the manifold to pulse valve 94 which is thereby activated momentarily to supply air to 2-position 3-way valve 86. This valve opens to its first position which supplies air therethrough from the manifold to actuate No. 1 air piston cylinder 95 in a first operating stroke of the system and is closed in its second position as aforesaid. This activates No. 1 piston 73 to move seal 25*a* in the third plane from its No. 1 position to its No. 2 position dwelling over the staple on the coin box whereby the aperture in seal 25*a* is positioned directly facing the outermost edge of the free end of the staple in the hasp as previously explained regarding FIG. 16.

When the No. 1 piston 73 reaches the end of its moving stroke, air from the manifold passing through the opened first position of valve 86 opens No. 1 sequence valve 87. Thereupon, the latter valve passes air from the manifold therethrough to actuate No. 2 air piston cylinder 96. This actuates No. 2 piston 74 in the second operating stroke of the system to move seal 25*a* downwardly in the fourth plane from its No. 2 position to its No. 3 position shown in FIG. 16. This movement disposes the free end of the staple into the aperture, and thereby seal 25*a* onto the free end of the staple to register the open space of the free end of staple and the aperture with the hole as previously mentioned. No. 1 check valve 97 receiving air at its input from the open first position of the 3-way valve 86 and at its output from No. 1 sequence valve 87 in equal magnitudes of pressure is neutralized at the moment.

When No. 2 piston 74 attains the end of its operating stroke, air from the output of No. 1 sequence valve 87 opens No. 2 sequence valve 98 which passes therethrough air from the manifold to actuate No. 3 air piston cylinder 99. This activates No. 3 piston 78 into opening 42 in seal 25*a* as hereinbefore stated to engage the outermost end of plunger 55 to move the latter in a lefthand angular direction in the hole toward the closed end thereof. This third operating stroke of the system moves the lefthand or inner end of the plunger through the open space in the free end of the staple and the aperture to a location adjacent to the closed end of the hole on the corresponding one sides of the staple and aperture. Upon the completion of this third stroke the righthand or outer end of the plunger is disposed proximate to portion 51 of projection 50 and offset 53 on the corresponding opposite sides of the staple free end and the aperture shown in FIG. 7. The plunger is now positioned in its locking state on the hasp of the coin box 10 in FIGS. 1 and 7 as hereinbefore stated. As the No. 2 check valve 100 is receiving air at its input from the No. 1 sequence valve and at its output from the No. 2 sequence valve in equal magnitudes of pressure, the No. 2 check valve is neutralized at the moment.

At the end of the third operating stroke just mentioned, No. 3 sequence valve 103 opened in response to the receipt of air from the No. 2 sequence valve 98 releases air therethrough from the manifold to No. 2 start valve 94 which is now opened. At the same time No. 3 check valve 104 receiving air at its output from the output of the No. 2 sequence valve and at its output from the output of the No. 3 sequence valve is neutralized at the moment. As No. 2 start valve 94 is now opened due to the insertion of security box **25*a* into the system in FIG. 18 as previously explained, air from the No. 3 sequence valve passes therethrough to close the first position of the 3-way valve and to open the second position of the 3-way valve, whereupon the first position thereof is closed to block the receipt of air from the manifold. The opened second position of the 3-way valve serves together with the Nos. 2, 3 and 3** check valves to relieve the air pressure on the several components of the system and thereby to exhaust the pressured air from the system. All check valves are now inoperative because the first position of the 3-way valve is closed, as aforesaid, thereby cutting off air from the manifold via the 3-way valve to the inputs of all valves in the system. This prepares the power system for its next succeeding cycle of operation.

At this time seal **25*a* being affixed in its locking state to the staple of the hasp mounted on the coin box shown in FIGS. 1, 16 and 18 permits the box to be removed from the system in FIG. 18. This actuates mechanical linkage 91 to move push elements 89 and 90 to return Nos. 1 and 2 start valves to their open positions. Now the coin box is conditioned by the locking seal attached thereto as just explained for use in the commercial field identified above. This completes one cycle of operation of the pneumatic power system shown in FIGS. 16–18. It is understood that seal 25 in FIG. 1 and seal 25*a* in FIGS. 16, 17 and 18** are one and the same seal, and that the use of the different combinations of digits, alphabetical characters or preselected symbols or the plunger and the seal outside surface be given both different combinations of preselected colors, digits and alphabetical characters or symbols, particularly for prearranged time periods. In this way the seal affixed onto the coin box assigned to each coin operated vending machine could be readily identifiable, and its control for usage could be limited to a very small number of operating and accounting personnel who could be easily isolated in case of larcency in connection with any such coin box.

At all times the quantities of seals differently coded as to plunger colors or digits or combinations of both colors and digits and conditioned in the nonlocking state in FIG. 6 and in the locking state on coin boxes in FIG. 7 in custody at a given time would be subject to rigid control involving audits on the spot without advance notice at given unannounced times. This would necessitate rigid accountability for each nonlocking and locking seal at all times, particularly since the pneumatic power system in FIGS. 16, 17 and 18 for changing nonlocking seals in FIG. 6 to locking seals in FIG. 7 as hereinbefore described is exclusively under control of the user of the latter nonlocking seals. This renders it difficult for larcenous personnel to duplicate the affixation of the nonlocking seals to the security boxes and thereafter to condition the latter seals to the locking state without facile and early detection.

It is evident that the pneumatic power system in FIGS. 16, 17 and 18 can be expeditiously utilized to change the seals from the nonlocking states in FIGS. 8, 10 and 12 to the locking states in respective FIGS. 9, 11 and 13 in the manner explained hereinbefore regarding the nonlocking and locking seal in FIGS. 6 and 7. However, the angular location of the No. 3 piston in FIGS. 16, 17 and 18 is obviated in FIGS. 14 and 15, and the latter piston is disposed in a rectilinear direction coincident with the No. 1 piston in the third plane but is still positioned at a 90° angle relative to the No. 2 piston in the fourth plane, not shown. Except for the relocation of No. 3 piston as just mentioned, the operation of the pneumatic power system in FIGS. 16–18 to change the nonlocking state of the seal in FIG. 14 to its locking state in FIG. 15 is identical with that previously described with reference to the seal in FIGS. 5–13.

It is understood that the invention herein is described in such respects as are illustrative of the operation thereof. Other arrangements may be devised by those skilled in the art without departing from the spirit and scope of the invention.

What is claimed is:

1. A seal for a hasp attaching a removable cover to a coin box to enclose the interior thereof and including a staple provided with a closed free end encircling open space interiorly thereof, said box mounted in coin activated vending apparatus for collecting coins deposited into said apparatus and serving thereupon to activate said apparatus into a vending state, comprising:

transparent means embodying an aperture coincident with an area of minimum dimension of said means and disposed to receive said staple end therein for mounting said means on said latter end while at the same time registering said staple end open space with said aperture, said means also embodying a hole coincident with an area of maximum dimension thereof; said areas of minimum and maximum dimensions being mutally perpendicularly disposed for registering said hole with said registered aperture and staple end open space and for extending said hole through said aperture and staple end open space to dispose a closed end of said hole on corresponding one sides of said respective aperture and staple end and an open end of said hole on corresponding opposite sides of said respective aperture and staple end; and plunger means initially located in a first position in said transparent means hole via said open end therein in which position both said inner and outer ends of said plunger means are located on said opposite sides of said aperture and staple end as visible in said transparent means when said transparent means is mounted on said staple end for indicating a nonlocking state of said latter means;

thereafter said plunger means further located in a second position in said hole via said open end thereof as said hole is registered with said aperture and staple end open space to locate said plunger means inner end as visible in said transparent means on said corresponding one sides of both said aperture and staple end and at the same time to continue the location of said plunger means outer end on said corresponding opposite sides of both said aperture and staple end; said last-mentioned locations of said plunger means inner and outer ends serving to change said plunger means from said first position to said second position in said hole in said transparent means for indicating a locking state of said latter means mounted on said staple end;

said second position of said plunger means in said hole in said transparent means mounted on said staple end together with said last-mentioned means constituting said seal for said hasp to impede pilfering said coins from said box.

2. The combination according to claim 1 in which said seal also provides an indication of an attempt at larcenous entry into the interior of said box via said hasp in such manner that a marred appearance of said plunger means in said second position in said hole as visible in said transparent means mounted on said staple end in response to unauthorized force exerted on said seal during such larcenous attempt provides said indication of said larcenous entry attempt for the pilfering of said coins from said box.

3. The seal according to claim 1 in which said transparent means embodies said hole having a curvilinear shape coincident with said area of maximum dimension of said latter means and comprising first and second spaced rectilinear segments mutually disposed at an angle other than 180° and having spaced free adjacent ends of said corresponding opposite sides of said aperture and staple end; said first segment having an outermost open end constituting with said hole open end on said corresponding opposite sides of said aperture and staple end; said second segment end having an innermost closed end constituting with said hole closed end on said corresponding one sides of said aperture and staple end; and in which said transparent means hole curvilinear shape also comprises a curvilinear segment connecting said spaced free adjacent ends of said first and second segments to constitute said last-mentioned hole curvilinear shape.

4. The seal according to claim 3 which includes a projection extending from an inner peripheral surface of said first segment into the interior thereof at a point proximate to the connection of said first and curvilinear segments, said point located a preassigned distance from said aperture opposite side; said projection comprising a first portion extending substantially perpendicularly from said point and a second portion sloping from a tip of said first portion toward said first segment open end; said second sloping portion aiding the disposal of said plunger means into said first and second positions in said transparent means hole and said first perpendicular portion biting into the peripheral surface of said plunger means adjacent thereto for impeding the removal of said latter means from said first position in said transparent means hole via said open end thereof, and said first perpendicular portion engaging an outermost end of said plunger means in said second position in said transparent means hole for impeding the removal of said plunger means from said latter position in said latter hole via said open end thereof; said point preassigned distance enabling said first perpendicular portion to impede the removal of said plunger means from both said first and second positions in said transparent means hole.

5. The seal according to claim 3 which includes an offset located at the connection of said first segment to said curvilinear segment thereby rendering a preselected dimension of said first segment less than a corresponding dimension of said curvilinear segment; said offset located a preassigned distance from said aperture opposite side; said offset engaging the outermost end of said plunger means in said second position in said transparent means hole for impeding the removal of said plunger means from said transparent means hole via said open end thereof; said offset preassigned distance enabling said offset to impede said plunger means removal.

6. The seal according to claim 3 which includes a projection extending from an inner peripheral surface of said first segment into the interior thereof at a point proximate to the connection of said first and curvilinear segments, said point located a preassigned distance from said aperture opposite side; said projection comprising a first portion extending substantially perpendicularly from said point and a second portion sloping from a tip of said first portion toward said first segment open end; said second sloping portion aiding the disposal of said plunger means into said first and second positions in said transparent means hole and said first perpendicular portion biting into the peripheral surface of said plunger means adjacent thereto for impeding the removal of said latter means from said first position in said transparent means hole via said open end thereof, and said first perpendicular portion engaging an outermost end of said plunger means in said second position in said transparent means hole for impeding the removal of said plunger means from said latter position in said latter hole via said open end thereof; said point preassigned distance enabling said first perpendicular portion to impede the removal of said plunger means from both said first and second positions in said transparent means hole; and an offset located at the connection of said first and curvilinear segments thereby rendering a preselected dimension of said first segment less than a corresponding dimension of said curvilinear segment; said offset located a predetermined distance from said aperture opposite side and disposed oppositely to said point; said offset engaging said outermost end of said plunger means in said transparent means hole for further impeding the removal of said plunger means from said second position in said transparent means hole via said open end thereof; said offset predetermined distance enabling said offset to impede said last-mentioned plunger means removal and being substantially equal to said point preassigned distance.

7. The seal according to claim 3 which includes a projection extending from an inner peripheral surface of said first segment into the interior thereof at a point proximate to the connection of said first and curilinear segments; said point located a first preassigned distance from said aperture opposite side; said projection comprising a first portion extending substantially perpendicularly from said latter point and a second portion sloping from a tip of said first portion toward said first segment open end; said latter portion aiding in the disposal of said plunger means into said first and second positions thereof in said transparent means hole via said open end thereof;

said plunger means provided with first and second recesses spaced a preselected distance apart lengthwise of said latter means on a peripheral surface thereof, said first recess located nearer to said plunger means inner end and spaced a predetermined distance therefrom;

said projection located in said first recess when said plunger means is disposed in said first position in said transparent means hole for impeding the removal of said plunger means from said transparent means hole via said open end thereof; said first recess being disposed a second preassigned distance from said aperture opposite side and said latter distance being substantially equal to said first preassigned distance when said projection is located in said first recess;

said projection located in said second recess when said plunger means is disposed in said second position in said transparent means hole for impeding the removal of said latter means from said transparent means hole via said open end thereof; said second recess being disposed a third preassigned distance from said aperture opposite side and said latter distance being equal to each of said first and second preassigned distances when said projection is located in said second recess;

said preselected and predetermined distances added together being adequate to locate said plunger means inner end on said aperture and staple end corresponding one sides.

8. The seal according to claim 3 which includes a certain portion of an inner peripheral surface of said second segment hole formed with an elongated depression extending normally from said aperture opposite side and terminating in an end wall located a first preassigned distance from said latter opposite side and said end wall disposed transversely of a lengthwise axis of said second segment hole; and first and second barbs spaced a preselected distance apart lengthwise of the peripheral surface of said plunger means; said first barb located nearer to said plunger means inner end and spaced a predetermined distance therefrom; each of said barbs formed with a first portion extending substantially vertically from said latter surface and a second portion sloping from a tip of said latter first portion toward said plunger means inner end; said second sloping portions of both said barbs aiding the disposals of said plunger means in both said first and second positions in said transparent means hole;

said first barb first portion engaging said depression end wall when said plunger means is located in said first position in said transparent means hole for impeding the removal of said latter means from said latter hole via said open end thereof; said first barb first portion located a second preassigned distance from said aperture opposite side and said latter distance being a substantially equal to said first preassigned distance when said first barb first portion engages said depression end wall;

said second barb first portion engaging said depression end wall when said plunger means is located in said second position in said transparent means hole for impeding the removal of said latter means from said latter hole via said open end thereof; said second barb first portion being disposed a third preassigned distance from said aperture opposite side and said latter distance being substantially equal to each of said first and second preassigned distances when said second barb first portion engages said depression end wall;

said preselected and predetermined distances added together being adequate to locate said plunger means inner end on said aperture and staple end corresponding one sides when said plunger means is located in said second position in said transparent means hole.

9. The seal according to claim 3 which includes the contiguous inner peripheral surfaces of said first and second rectilinear and said curvilinear segments holes and thereby the contiguous inner peripheral surfaces of said transparent means hole and the outer peripheral surface of said plunger means located in said first and second positions in said latter hole being substantially smooth; said latter means provided with a predetermined coefficient of rigidity for tending to maintain said plunger means in an initially rectilinear shape thereby being caused to tend to resist bending from said first rectilinear segment through said curvilinear segment into said second rectilinear segment as said latter means is located in each of said first and second positions thereof in turn; said coefficient of rigidity also impeding the removal of said plunger means from said first and second positions in said transparent means hole via said open end thereof.

10. The seal according to claim 1 in which said transparent means includes therein said hole extending in a rectilinear shape coincident with said area of maximum dimension of said latter means; and which further includes:

a projection extending from an inner peripheral surface of said hole into the interior thereof at a point located a first preassigned distance from said aperture opposite side; said projection comprising a first portion extending substantially perpendicularly from said latter point and a second portion sloping from a tip of said first portion toward said hole open end; said latter portion aiding in the disposal of said plunger means into said first and second positions thereof in said transparent means hole via said open end thereof;

said plunger means provided with first and second recesses spaced a preselected distance apart lengthwise of said latter means on a peripheral surface thereof, said first recess located nearer to said plunger means inner end and spaced a predetermined distance therefrom;

said projection located in said first recess when said plunger means is disposed in said first position in said transparent means hole for impeding the removal of said plunger means from said transparent means hole via said open end thereof; said first recess being disposed a second preassigned distance from said aperture opposite said and said latter distance being substantially equal to said first preassigned distance when said projection is located in said recess;

said projection located in said second recess when said plunger means is disposed in said second position in said transparent means hole for impeding the removal of said latter means from said transparent means hole via said open end thereof; said second recess being disposed a third preassigned distance from said aperture opposite side and said latter distance being equal to each of said first and second preassigned distances when said projection is located in said second recess;

said preselected and predetermined distances added together being adequate to locate said plunger means inner end on said aperture and staple end corresponding one sides.

11. The seal according to claim 1 which includes power means activated in response to the connection of said box therewith for actuating said transparent means to receive said staple end in said aperture in said latter means to mount said transparent means on said staple end and simultaneously therewith to register said staple end open space with said registered aperture and hole; thereafter said power means further activated for engaging said plunger means outer end via said transparent means hole open end, while said plunger means is located in said first position in said transparent means hole, to move said latter means in said latter hole to locate said plunger means inner and outer ends on said corresponding one and opposite sides, respectively, of said aperture and staple end, thereby to move said plunger means from said first position to said second position in said transparent means hole.

12. In combination with a security box containing contents of monetary value and having a removable cover and a hasp attaching said cover to said box for enclosing the interior thereof, said hasp including a staple formed with a free end encircling open space in the interior thereof;

means for sealing said hasp to impede larcenous entry into said box interior via said hasp to pilfer said contents therefrom and also to provide an indication of such entry, comprising:

transparent means including an aperture for receiving said staple end therein to mount said latter means on said latter end and at the same time to register said aperture with said staple end open space; and plunger means disposed interiorly of said transparent means to extend through said registered aperture and staple end open space for locating opposite ends of said plunger means on respective opposite sides of said aperture and staple end and thereby in a substantially irremovable position in said transparent means;

said mounting of said transparent means on said staple end and said disposal of said plunger means in said transparent means serving to seal said hasp for impeding said larcenous entry into said box interior, and a marred appearance of said plunger means visible in said position in said transparent means in response to unauthorized force exerted on said transparent means and said plunger means disposed therein serving to provide said indication of an attempt at such larcenous entry.

13. A seal and a hasp attaching a removable cover to a security box for enclosing the interior thereof, said hasp including a staple having a closed free end encircling open space interiorly thereof, comprising:

transparent means formed with an aperture disposed in a first plane perpendicular to one axis of said means and also with a hole disposed in a second plane coincident with said axis and perpendicular to said first plane and thereby transverse to said aperture to register said aperture with said hole, said aperture and hole being mutually positioned in said respective first and second planes to extend said hole through said aperture for disposing one and opposite ends of said hole on corresponding one and opposite sides, respectively, of said aperture; said one and opposite ends of said hole being closed and open, respectively; and plunger means initially disposed in a first position in said hole via said open and thereof to locate both inner and outer ends of said latter means on said aperture opposite side as visible in said transparent means;

said transparent means mounted on said staple end to register said staple end open space with said aperture and hole for further disposing said plunger means from said first position to a second position in said hole to depose said inner end through said registered aperture and staple end open space for further location on said aperture one side and thereby on a corresponding one side of said staple end with said plunger means outer end retained in location on said aperture opposite side and thereby on a corresponding opposite side of said staple end as visible in said transparent means;

said mounting of said transparent means on said staple end and said last-mentioned locations of both said respective plunger means inner and outer ends providing said seal on said hasp to impede larcenous entry into said box interior via said hasp and thereby to impede pilfering contents from said box interior.

14. The seal and hasp according to claim 13 which includes power means activated in response to a connection of said box therewith for actuating said transparent means to receive said staple end in said aperture therein to mount said transparent means on said staple end and to register said staple end open space with said aperture and hole; thereafter said power means further activated for engaging said plunger means outer end via said hole open end to dispose said plunger means inner end through said registered aperture and staple end open space and hole for location in said hole on said corresponding one sides of said aperture and staple end while at the same time retaining said plunger means outer end in location on said corresponding opposite sides of said aperture and staple end.

15. The seal and hasp according to claim 14 which provides an indication of an attempt at larcenous entry into said box interior via said hasp in such manner that a marred appearance of said plunger means having said inner and outer ends thereof located on said respective one and opposite sides of said aperture as staple end and visible in said transparent means in response to unauthorized force exerted on said seal during such larcenous entry attempt serves to provide said indication thereof.

16. In combination with a hasp attaching a removable cover to a coin box for enclosing the interior thereof, said hasp including a staple having a closed free end encircling open space interiorly thereof, said box mounted in coin activated vending apparatus for collecting coins deposited into said apparatus and serving thereupon to activate said apparatus into a vending state;

means for providing a seal for said hasp to impede pilfering said coins from said box, comprising:

transparent means formed with an aperture located in a first plane and with a hole located in a second plane, said first and second planes being mutually perpendicularly disposed in areas of minimum and maximum dimensions, respectively, of said means; said first plane and thereby said aperture intersecting said second plane and thereby said hole at a preselected section of said transparent means to dispose one end of said hole on one side of said aperture and an opposite end of said hole on an opposite side of said aperture; said hole one end being closed and said hole opposite end being open;

plunger means initially movably disposed in said hole via said open end thereof to locate said plunger means inner and outer ends on said aperture opposite side thereby to locate said plunger means in a first position in said hole on said aperture opposite side for indicating a non-locking state of said latter means; and power means connectible to said box and activated in response to a preselected connection of said box therewith for disposing said staple end in said aperture to mount said transparent means on said latter end while at the same time registering said staple end open space with said aperture and hole and thereafter to engage said plunger means outer end via said hole open end to move said plunger means from said first position to a second position in said hole to pass said plunger means inner end through said aperture and staple end open space registered with said hole to locate said plunger means inner end on said aperture one side and thereby on a corresponding one side of said staple end adjacent to said hole closed end while at the same time maintaining the location of said plunger means outer end on said aperture opposite side and thereby on said corresponding opposite side of said staple end; said last-mentioned locations of said plunger means inner and outer ends serving to locate said plunger means in a second position in said hole for indicating a locking state of said latter means;

said transparent means including said plunger means located in said second position in said hole as mounted on said staple end for providing said seal means for said hasp to impede pilfering of said coins from said box.

17. The combination according to claim 16 in which said seal means also provides an indication of an attempt at larcenous entry into said box interior via said hasp in such manner that a marred appearance of said plunger means in said second position as visible in said transparent means mounted on said staple end in response to unauthorized force exerted on said seal means during such larcenous attempt provides said indication thereof for pilfering said coins from said box interior.

18. The combination according to claim 16 in which said transparent means embodies said hole having a curvilinear shape and comprising first and second rectilinear segments mutually disposed at an angle other than 180° and having spaced free adjacent ends on said corresponding opposite sides of said aperture and staple end; said first segment having an outermost open end coincident with said hole opposite open end on said corresponding opposite sides of said aperture and staple end; said second segment having an innermost closed end coincident with said hole closed end on said corresponding one sides of said aperture and staple end and further in which said latter curvilinear shape hole also embodies a curvilinear segment connecting said adjacent free ends of said first and second segments.

19. The combination according to claim 18 which includes a projection extending from an inner peripheral surface of said first segment into the interior thereof at a point proximate to the connection of said first and curvilinear segments, said point located a preassigned distance from said aperture opposite side; said projection comprising a first portion extending substantially perpendicularly from said latter point and a second portion sloping from a tip of said first portion toward said first segment open end, said second portion aiding the disposal of said plunger means into said first and second positions in said hole and said first perpendicular portion biting into the peripheral surface of said plunger means adjacent thereto for impeding the removal of said latter means from said first position in said hole via said open end thereof, and said first perpendicular portion also engaging said plunger means outer end in said second position in said hole for impeding the removal of said plunger means from said latter position in said hole via said open end thereof; said point preassigned distance enabling said first perpendicular portion to impede the removal of said plunger means from both said first and second positions thereof in said hole.

20. The combination according to claim 18 which includes an offset provided at the connection of said first and curvilinear segments thereby rendering a preselected dimension of said first segment less than a corresponding dimension of said curvilinear segment; said offset located a preassigned distance from said aperture opposite side; said offset engaging said plunger means outer end in said second position in said hole for impeding the removal of said latter means from said hole via said open end thereof; said offset preassigned distance enabling said offset to impede said last-mentioned plunger means removal.

21. The combination according to claim 18 which includes a projection extending from an inner peripheral surface of said first segment into the interior thereof at a point proximate to the connection of said first and curvilinear segments, said point located a first preassigned distance from said aperture opposite side; said projection comprising a first portion extending substantially perpendicularly from said latter point, and a second portion sloping from a tip of said first portion toward said first segment open end; said second sloping portion aiding the disposal of said plunger means into said first and second positions thereof in said hole, and said first perpendicular portion biting into the peripheral surface of said plunger means adjacent thereto for impeding the removal of said latter means from said first position in said hole via said open end thereof, and said first perpendicular portion engaging said plunger means outer end in said second position thereof in said hole for impeding the removal of said latter means from said latter position in said hole via said open end thereof; said point preassigned distance enabling said first perpendicular portion to impede the removal of said plunger means from both said first and second positions in said hole; and an offset provided at the connection of said first and curvilinear segments thereby rendering a preselected dimension of said first segment less than a corresponding dimension of said curvilinear segment; said offset located a predetermined distance from said aperture opposite side and disposed oppositely to said point; said offset engaging said plunger means outer end in said hole for additionally impeding the removal of said plunger means from said second position in said hole via said open end thereof; said offset predetermined distance enabling said offset to impede said latter plunger means removal and being substantially equal to said point preassigned distance.

22. The combination according to claim 18 which includes a projection extending from an inner peripheral surface of said first segment into the interior thereof at a point proximate to the connection of said first and curvilinear segments; said point located a first preassigned distance from said aperture opposite side; said projection comprising a first portion extending substantially perpendicularly from said latter point, and a second portion sloping from a tip of said first portion toward said first segment open end; said latter portion aiding the disposal of said plunger means into said first and second positions in said hole via said open end thereof;

said plunger means provided with first and second recesses spaced a preselected distance apart lengthwise of said latter means on a peripheral surface thereof, said first recess located nearer to said plunger means inner end and spaced a predetermined distance therefrom;

said projection located in said first recess when said plunger means is disposed in said first position in said hole for impeding the removal of said latter means from said hole via said open end thereof; said first recess being disposed a second preassigned distance from said aperture opposite side and said latter distance being substantially equal to said first preassigned distance when said projection is located in said first recess;

said projection located in said second recess when said plunger means is disposed in said second position in said hole for impeding the removal of said latter means from said hole via said open end thereof; said second recess being located a third preassigned distance from said aperture opposite side and said latter distance being equal to each of said first and second preassigned distances when said projection is located in said second recess;

said preselected and predetermined distances added together being adequate to locate said plunger means inner end on said aperture and staple end corresponding one sides when said plunger means is disposed in said second position in said hole.

23. The combination according to claim 18 which includes a certain portion of an inner peripheral surface of said second segment hole formed with an elongated depression extending normally from said aperture opposite side and terminating in an end wall located a first preassigned distance from said latter opposite side and said end wall disposed transversely of a lengthwise axis of said last-mentioned hole;

first and second barbs spaced a preselected distance apart lengthwise of the peripheral surface of said plunger means; said first barb located nearer to said plunger means inner end and spaced a predetermined distance therefrom; each of said barbs formed with a first portion extending substantially vertically from said latter surface and a second portion sloping from a tip of said latter first portion toward said plunger means inner end; said sloping portions of both said barbs aiding the disposals of said plunger means in both said first and second positions in said transparent means hole;

said first barb first portion engaging said depression end wall when said plunger means is located in said first position in said transparent means hole for impeding the removal of said latter means from said latter hole via said open end thereof; said first barb first portion located a second preassigned distance from said aperture opposite side and said latter distance being substantially equal to said first preassigned distance when said first barb first portion engages said depression end wall;

said second barb first portion engaging said depression end wall when said plunger means is located in said second position in said transparent means hole for impeding the removal of said latter means from said latter hole via said open end thereof; said second barb first portion being disposed a third preassigned distance from said aperture opposite side and said latter distance being substantially equal to each of said first and second preassigned distances when said second barb portion engages said depression end wall;

said preselected and predetermined distances added together being adequate to locate said plunger means inner end on said aperture and staple end corresponding one sides when said plunger means is located in said second position in said transparent means hole.

24. The combination according to claim 18 which includes the contiguous inner peripheral surfaces of said first and second rectilinear and said curvilinear segments holes and thereby the contiguous inner peripheral surface of said transparent means hole and the outer peripheral surface of said plunger means located in said first and second positions in said latter hole being substantially smooth; said latter means provided with a predetermined coefficient of rigidity for tending to maintain said plunger means in an initially rectilinear shape thereby being caused to tend to resist bending from said first rectilinear segment through said curvilinear segment into said second rectilinear segment as said latter means is located in each of said first and second positions thereof in turn; said coefficient of rigidity also impeding the removal of said plunger means from said respective latter positions in said transparent means hole via said open end thereof.

25. The combination according to claim 16 in which said transparent means includes therein said hole extending in a rectilinear form coincidental with said area of maximum dimension of said latter means; and which further includes:

a projection extending from an inner peripheral surface of said first segment into the interior thereof at a point located a first preassigned distance from said aperture opposite side; said projection comprising a first portion extending substantially perpendicularly from said latter point, and a second portion sloping from a tip of said first portion toward said first segment open end; said latter portion aiding the disposal of said plunger means into said first and second positions in said hole via said open end thereof;

said plunger means provided with first and second recesses spaced a preselected distance apart lengthwise of said latter means on a peripheral surface thereof, said first recess located nearer to said plunger means inner end and spaced a predetermined distance therefrom;

said projection located in said first recess when said plunger means is disposed in said first position in said hole for impeding the removal of said latter means from said hole via said open end thereof; said first recess being disposed a second preassigned distance from said aperture opposite side and said latter distance being substantially equal to said first preassigned distance when said projection is located in said first recess;

said projection located in said second recess when said plunger means is disposed in said second position in said hole for impeding the removal of said latter means from said hole via said open end thereof; said second recess being located a third preassigned distance from said aperture opposite side and said latter distance being equal to each of said first and second preassigned distances when said projection is located in said second recess;

said preselected and predetermined distances added together being adequate to locate said plunger means inner end on said aperture and staple end corresponding one sides when said latter means is disposed in said second position in said hole.

26. The combination according to claim 16 in which said transparent means comprises two elements having contiguous opposing surfaces and embodying said aperture in said first plane disposed in areas of minimum dimensions of both said elements; one of said elements formed with a groove having an open side coincident with said one element contiguous surface in said second plane disposed in an area of maximum dimensions of said one element; and said contiguous surface of the other of said elements closing said groove open side in said latter plane disposed in an area of maximum dimension of said other element; said one element groove and said other element contiguous surface forming said transparent means hole.

27. The combination according to claim 16 in which said plunger means is provided with a predetermined coefficient of rigidity for enabling the expeditious location of said latter means in both said first and second positions in said transparent means hole via said open end thereof and at the same time impeding the removal of said plunger means from said latter hole.

28. The combination according to claim 16 in which said plunger means is provided with a preselected color for enabling the identification of said seal means used in a preassigned time period and geographical area.

29. The combination according to claim 16 in which said transparent means is provided with a preselected number of digits for enabling the identification of said seal means in a preassigned time period and geographical area.

30. The combination according to claim 16 in which said plunger means is provided with a preselected color and said transparent means with a preassigned number of digits for enabling the identification of said seal means used in a preselected time period and geographical area.

31. The combination according to claim 16 in which said power means initially moves said transparent means aperture opposite to said staple end preparatory to the mounting of said latter means on said latter end.

32. The combination according to claim 31 in which said power means further moves said transparent means to dispose said staple end in said transparent means aperture for mounting said transparent means on said staple end and at the same time for rendering said plunger means outer end in said first position in said transparent means hole available via said open end thereof to said power means.

33. The combination according to claim 32 in which said power means engages said plunger means outer end via said transparent means hole open end to move said plunger means in said transparent means hole from said first position to said second position therein.

34. The combination according to claim 16 in which said power means is activated in a plurality of predetermined sequential steps in such manner that said power means in a first step moves said transparent means to dispose said aperture therein into juxtaposition with said staple end, in a second step further moves said transparent means to dispose said staple end in said aperture in said latter means for mounting said transparent means on said staple end and simultaneously therewith for rendering said plunger means outer end in said first position in said transparent means hole available via said open end thereof to said power means; and in a third step engages said last-mentioned plunger means outer end via said latter hole open end to move said plunger means in said last-mentioned hole from said first position to said second position therein.

35. In combination with a hasp attaching a cover to a coin box for enclosing the interior thereof, said hasp including a staple having a closed free end encircling open space interiorly thereof, said box mounting in a coin activated vending apparatus for collecting coins deposited into said apparatus and serving thereupon to activate said apparatus into a vending state;

means to provide a seal for said hasp to impede pilfering said coins from said box, comprising:

transparent means formed with an aperture located in a first plane and with a hole located in a second plane, said first and second planes being mutually perpendicularly disposed in areas of minimum and maximum dimensions, respectively of said latter means; said first plane and thereby said aperture intersecting said second plane and thereby said hole at a preselected section of said latter means to position one end of said hole on one side of said aperture and an opposite end of said hole on an opposite side of said aperture; said hole one and opposite ends being closed and open, respectively;

plunger means initially movably disposed in said hole via said open end thereof to locate inner and outer ends of said latter means in said hole on said aperture opposite side thereby to locate said plunger means in a first position in said hole for indicating a non-locking state of said plunger means; and power means connectible to said box and activated in response to a preselected connection of said box therewith into a plurality of predetermined sequential steps for moving said plunger means in said hole via said open end thereof in such manner that a first step moves said transparent means to dispose said aperture thereof in juxtaposition with said staple end, a second step further moves said transparent means from said first position to a second position to dispose said staple end in said aperture in said latter means for mounting said transparent means on said staple end and simultaneously therewith for registering said staple end open space with said aperture and hole and rendering said outer end of said plunger means in said first position in said transparent means hole available via said open end thereof to said power means; and a third step engages said plunger means outer end via said hole open end to move said plunger means in said hole to pass said inner end thereof through said staple end open space registered with said aperture and hole to locate said last-mentioned end on said aperture one side and thereby on a corresponding one side of said staple end proximate to said hole closed end while at the same time maintaining the location of said plunger means outer end on said aperture opposite side and thereby on a corresponding opposite side of said staple end; said last-mentioned locations of said plunger means inner and outer ends serving to locate said plunger means in said second position in said hole for indicating a locking state of said latter means;

said transparent means mounted on said staple end and including said plunger means located in said second position in said transparent means hole constituting said seal means for said hasp to impede pilfering of said coins from said box.

36. The combination according to claim 35 in which said seal means also provides an indication of an attempt at larcenous entry into said box to pilfer said coins therefrom in such manner that a marred appearance of said plunger means located in said second position as visible in said transparent means in response to an unauthorized force exerted on said larcenous entry attempt seal during such larcenous attempt serves to provide said indication.

* * * * *